US007086203B2

(12) United States Patent
Owen

(10) Patent No.: US 7,086,203 B2
(45) Date of Patent: Aug. 8, 2006

(54) SUPPORT

(76) Inventor: George Owen, Pendle View Farm, Tosside, Skipton, North Yorkshire (GB) BD 23 4 SJ ( * ) Notice: Subject to any disclaimer, the term of this patent is extended or adjusted under 35 U.S.C. 154(b) by 0 days.

(21) Appl. No.: 10/250,803

(22) PCT Filed: Jan. 4, 2002

(86) PCT No.: PCT/GB02/00017

§ 371 (c)(1),
(2), (4) Date: Nov. 28, 2003

(87) PCT Pub. No.: WO02/059436

PCT Pub. Date: Aug. 1, 2002

(65) Prior Publication Data

US 2004/0088945 A1 May 13, 2004

(30) Foreign Application Priority Data

Jan. 6, 2001 (GB) ..... 0100372.2

(51) Int. Cl.
*E04C 5/16* (2006.01)
*E04F 15/00* (2006.01)
*E04G 25/00* (2006.01)

(52) U.S. Cl. ..... 52/126.6; 52/678; 52/365; 52/371; 404/135; 404/136; 248/354.3

(58) Field of Classification Search ..... 52/126.6, 52/126.7, 678, 365, 371; 404/135, 136; 248/345.3; 254/13
See application file for complete search history.

(56) References Cited

U.S. PATENT DOCUMENTS 2,281,946 A * 5/1942 O'Neill, Jr. ..... 52/678
2,541,793 A 2/1951 Thompson
2,544,780 A * 3/1951 Dean ..... 254/100
2,956,653 A * 10/1960 Liskey, Jr. ..... 52/396.06
3,006,115 A * 10/1961 Bror ..... 52/365
3,398,933 A * 8/1968 Haroldson ..... 254/98
4,158,937 A * 6/1979 Henry ..... 52/365
4,321,024 A 3/1982 Terraillon
4,371,330 A 2/1983 Hefferman (Continued)

FOREIGN PATENT DOCUMENTS

DE 801536 1/1951

(Continued)

OTHER PUBLICATIONS

Access Science McGraw-Hill Encyclopedia of Science and Technology Online, defintion of "push fit", 1 page, Sep. 2003.*

(Continued)

*Primary Examiner*—Robert Canfield
(74) *Attorney, Agent, or Firm*—King & Schickli, PLLC

(57) ABSTRACT

A support apparatus (10) for providing a robust load bearing support for screed rails (12) during the laying of concrete in which the height of the screed rails can be accurately adjusted and supported so as to allow the screed rails to be used for carrying concrete levelling devices such as a roller beam levelling device consists of a ground engaging base block (14), a first member (22) releasably connected at its lower end to the base block and a support member (28) releasably connected to the upper end of the first member for supporting the screed rails (12) at a desired height above the ground (16) where the first member and support member combination is of adjustable length to permit adjustment of the height of the screed rails carried thereby.

14 Claims, 3 Drawing Sheets

U.S. PATENT DOCUMENTS

| | | | | |
|---|---|---|---|---|
| 6,363,685 | B1 * | 4/2002 | Kugler | 52/745.05 |
| 2004/0035064 | A1 * | 2/2004 | Kugler et al. | 52/126.6 |
| 2004/0163334 | A1 * | 8/2004 | Carlson | 52/126.6 |

FOREIGN PATENT DOCUMENTS

| | | | |
|---|---|---|---|
| DE | 807229 | | 6/1951 |
| DE | 852149 | | 10/1952 |
| DE | 8626503.2 | | 2/1988 |
| FR | 697894 | | 1/1931 |
| FR | 1112899 | | 3/1956 |
| FR | 1150499 | | 1/1958 |
| FR | 1533357 | | 7/1968 |
| FR | 2549870 | * | 2/1985 |
| GB | 1057138 | | 2/1967 |
| GB | 1124201 | | 8/1968 |
| GB | 2 313 615 A | | 3/1997 |
| NL | 6502809 | | 9/1966 |
| WO | WO 90/03478 | | 5/1990 |

OTHER PUBLICATIONS

Access Science McGraw-Hill Encyclopedia of Science and Technology Online, defintion of "press fit", 1 page, Sep. 2003.*

* cited by examiner

SUPPORT

This invention relates to a support apparatus for use in laying concrete and more particularly, but not exclusively, to apparatus for supporting inter-alia screed rails.

During the laying of concrete in applications where the level of the surface of the concrete has to be accurately controlled, it is usual to provide supports which are adjustable in height to support the screed rails which are, for example, in the form of scaffold poles disposed in spaced-apart orientation and which are then used as reference levels to level the surface of the concrete poured therebetween.

Known supports for such scaffold pole screed rails are usually in the form of a chair having two legs on which a stirrup is adjustably mounted on which the scaffold pole type of screed rail rests. Alternatively, the known support can be in the form of a tripod from which the stirrup is adjustably suspended to carry the scaffold pole. A further alternative is a support formed of plastic material in the form of a cross-shaped base having an upwardly extending plastic tube carrying a plastic stirrup which is screwed into the top of the plastic tube to support a scaffold pole type of screed rail.

In applications where the level of the concrete to be laid has to be accurately positioned, for example, where a laser levelling system, or surveyors or builders levelling systems are employed to set the height of the screed rails and the screed rails are used as a support for a heavyweight roller beam levelling device, a vibrating roller beam levelling device or other type of screed rail supporting levelling device and different thicknesses of concrete have to be laid, particularly relatively deep thicknesses and where the concrete is for heavy duty use, the known supports which are for use in lightweight applications suffer from a number of disadvantages.

The known supports suffer from the disadvantage that they do not provide a sufficiently robust support to allow accurate positioning and maintenance of the level of the screed rails supported thereby during laying and surfacing of the concrete. They also suffer from the disadvantage that they do not allow the use of, or accurate positioning of, heavy duty screed rails, such as steel plate or beams, which are necessary for supporting a roller beam levelling device or a vibrating roller beam levelling device or the like.

The known supports also suffer from the disadvantage that they do not facilitate accurate positioning of screed rails over an extensive range of heights to accommodate an extensive range of concrete thicknesses.

The object of the present invention is to provide a support apparatus for screed rails during laying of concrete in which one or more of the above disadvantages of the known supports is alleviated.

According to this invention, a support apparatus for supporting at a desired height one or more elongate members such as rails used in laying a concrete floor, road or other surface comprises a ground engaging base block haying different height to width, a first member releasably connected at its lower end to the upper face of the base block and a support member releasably connected to the upper end of the first member for supporting the or each elongate member at a desired height above the ground, the first member and support member combination being of adjustable length to permit adjustment of the height of the or each elongate member supported thereby above the ground and thus the level of the concrete floor, road or other surface which is to be laid characterised in that the base block of different height to width provides different ranges of height according to which face of the block is disposed uppermost in use.

Preferably, the releasable connection between the first member and the support member is a screw-threaded connection to enable the length of the combination to be adjusted.

Preferably, also, the base block has a bore in the upper face and a bore in the side face and at least the lower end of the first member is a push-fit in either one of the bores to form the releasable connection.

Each one of the bores, preferably, extends through the base block.

Preferably, each bore has an enlarged end portion into which at least the lower end of the first member is a push-fit until the end face thereof engages in contact with the end face of the enlarged end portion of the bore.

Preferably, also, the first member comprises two or more components consisting of at least one hollow tubular member whose lower end is a push-fit into the enlarged end portion of the associated bore in the base block and an internally screw-threaded hollow adapter which is a push-fit into an enlarged diameter end portion of the associated hollow tubular member remote from the base block.

Preferably, the enlarged end portion of each bore in the base block, the lower end of the first member which is a push fit therein, the lower end of the or each hollow tubular member which is one component of the first member, the enlarged end portion of the hollow tubular member remote from the base block, and the adapter which is a second component of the first member and is a push-fit into either the enlarged end portion of the hollow tubular member remote from the base block or into the enlarged end portion of the associated bore in the base block are of non-circular shape in cross section to prevent rotation of the first member, the components thereof and the adapter relative to the base block.

Preferably, also, the enlarged end portion of each bore in the base block, the lower end of the first member which is a push fit therein, the lower end of the or each hollow tubular member which is one component of the first member, the enlarged end portion of the hollow tubular member remote from the base block, and the adapter which is a second component of the first member and is a push-fit into either the enlarged end portion of the hollow tubular member remote from the base block or into the enlarged end portion of the associated bore in the base block are of hexagonal shape in cross-section to prevent rotation of the first member, the components thereof and the adapter relative to the base block.

The support member, preferably, has an externally screw-threaded portion which is screwed into the internally screw-threaded adapter to provide adjustment of the length of said combination.

Preferably, the base block is rectangular in shape.

Preferably, also, at least one face of the base block is formed with two or more transversely extending slots adapted to receive, locate and support therein one or more steel reinforcing rods or portions of steel reinforcing mesh to support said rods or mesh at a suitable height above the ground and a suitable depth below the surface of the concrete floor, road or other surface to be laid.

The base block is, preferably, formed of concrete or may be formed of a plastics material.

A preferred embodiment of the invention will now be described by way of example only, with reference to the accompanying drawings of which:—

Figures 1, 2, 3:
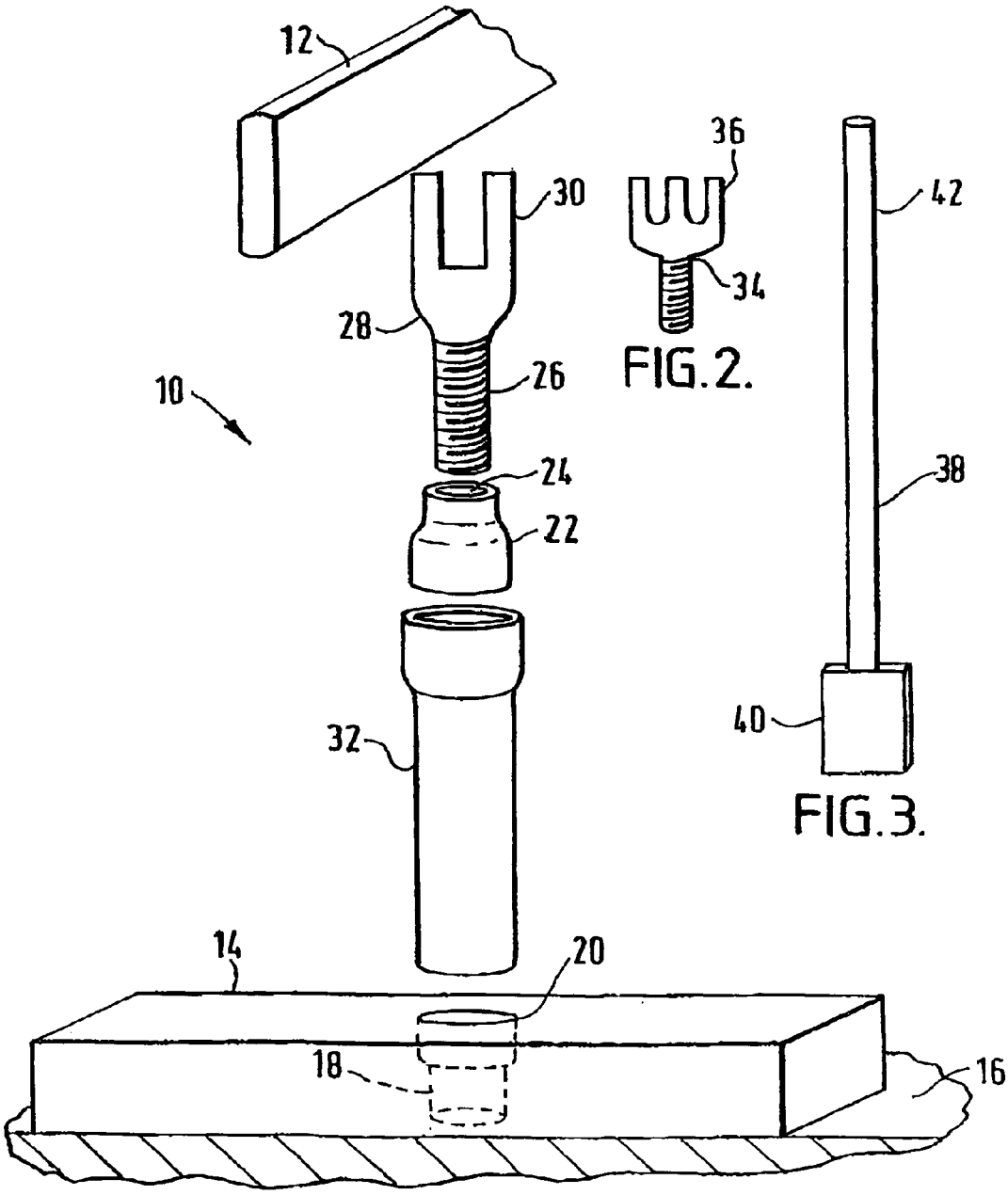
FIG. 1 is a front elevation of a dismantled support apparatus.
FIG. 2 is a front elevation of an alternative form of support for the support apparatus.
FIG. 3 is a front elevation of an adjustment device for use with the support apparatus.
Figure 4A:
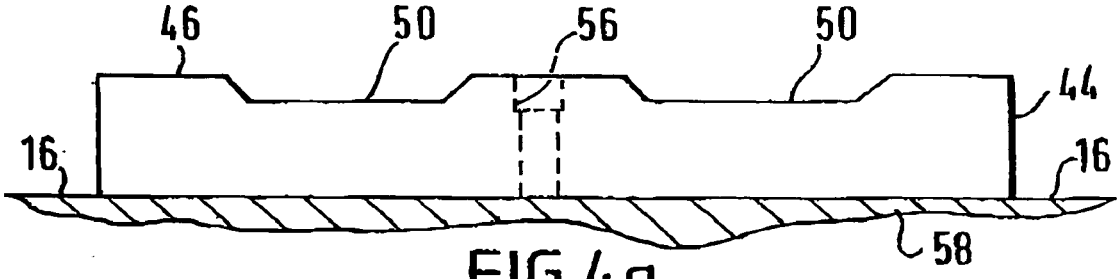
FIG. 4 is a side elevation of an alternative shape of a block of the support apparatus disposed in four positions (a), (b), (c) and (d) for providing alternative ranges of heights of support apparatus.
Figure 4B:
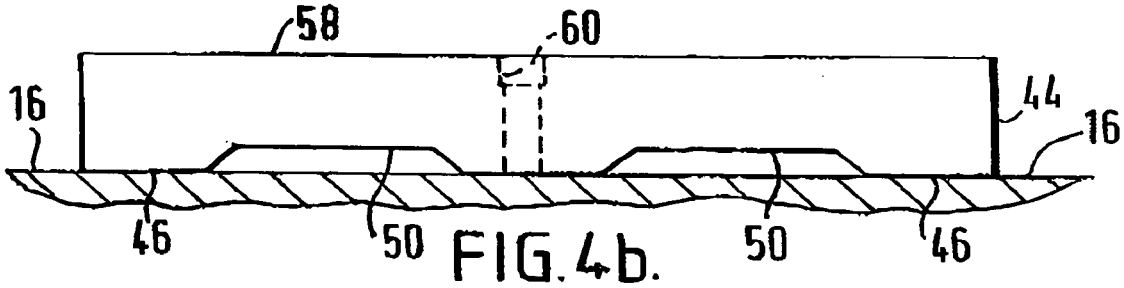
Figure 4C:
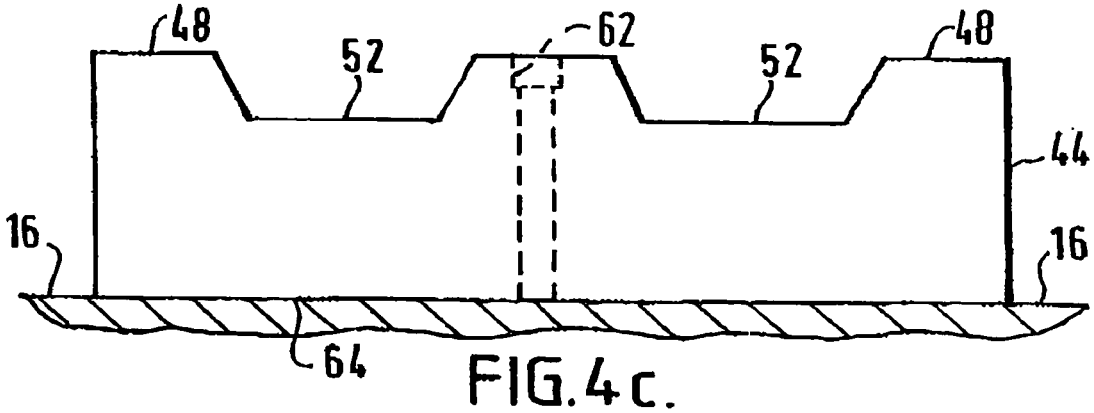
Figure 4D:
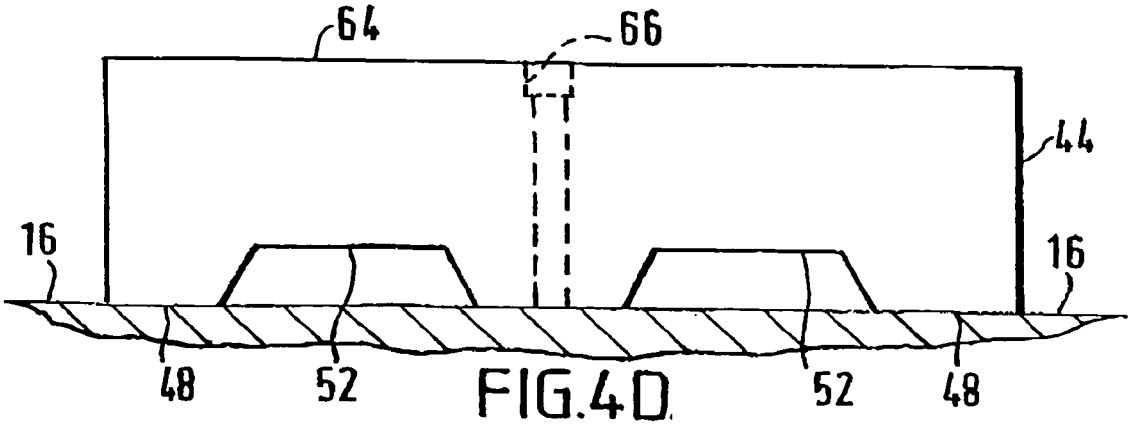
Figure 5:
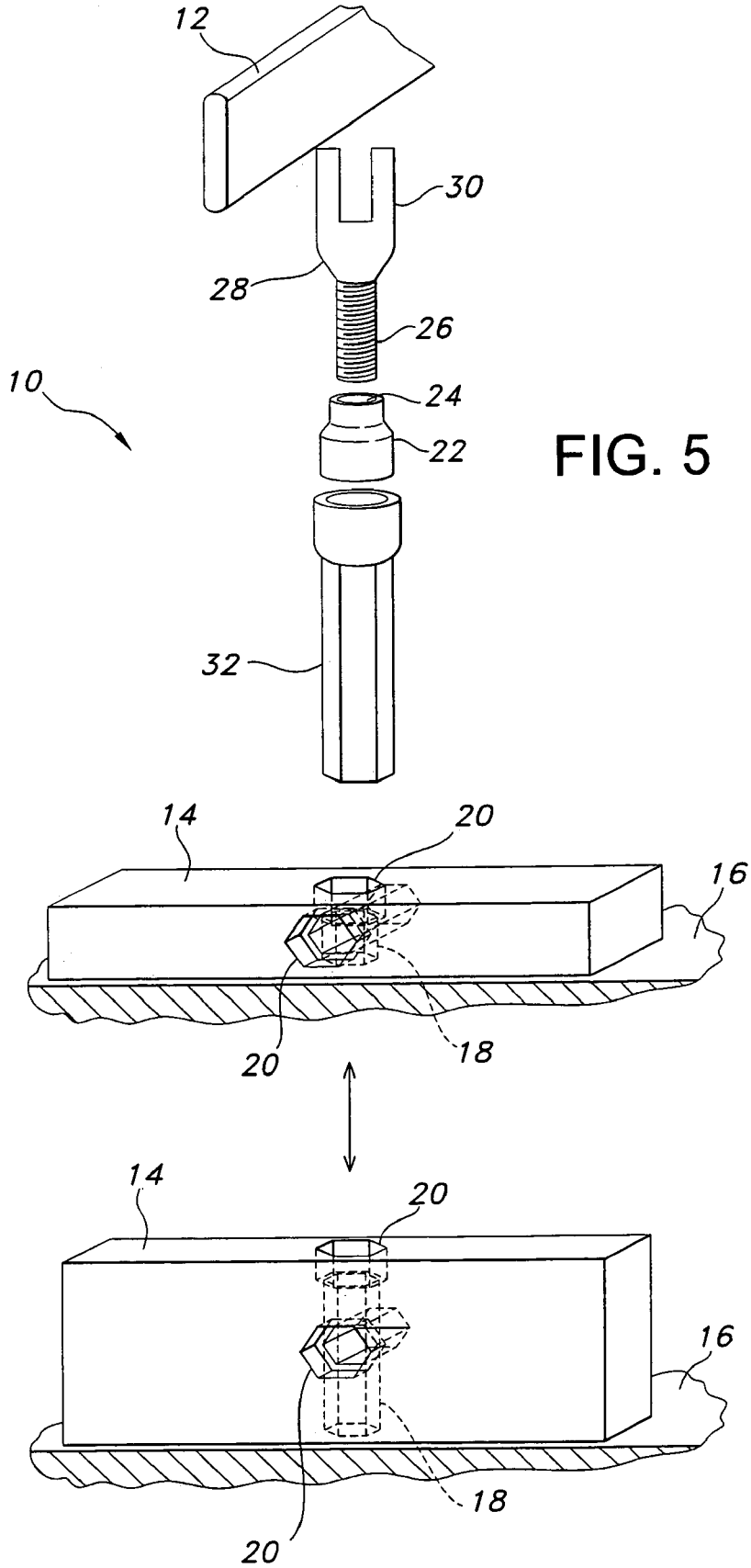
FIG. 5 is a front elevation of a dismantled support apparatus, having a base block with two hexagonal bores therethrough.

Referring now to the drawings, a support apparatus indicated generally at 10 for supporting a screed rail 12 of steel bar having a rectangular cross-section typically measuring 50 millimetres by 8 millimetres which is used in laying a concrete slab of 200 millimetres thickness (not shown) comprises a base block 14 of rectangular shape which is formed from concrete and rests stably on a ground surface 16 onto which the concrete slab is to be laid. The base block 14 has a bore 18 extending therethrough from an upper surface of the block 14 to the lower ground engaging surface thereof. The base block 14 can also be provided with additional bores 18 extending between the side faces or the end faces of the block 14 providing different ranges of height according to the orientation of the block 18 (see FIG. 5). Alternatively, blocks 14 having a single bore 18 are provided, one block 14 having a bore 18 extending between the side faces, another block 14 having a bore 18 extending between the end faces and the block 14 with bore 18 extending between the upper and lower surfaces as shown in FIG. 1 of the drawings. Different ranges of height of the apparatus can be obtained according to which one of said blocks 14 is selected for use. The bore 18 has an enlarged diameter portion 20 at one end into which, in the simplest form of the support apparatus 10, an adapter 22 forming a first member is a push-fit. The adapter 22 is a steel tube having a screw-threaded bore 24 and an externally screw-threaded portion 26 of one end of a support member 28 is screwed therein. The support member 28 is formed of steel and is provided at its other end with a bi-furcated portion 30 in which the screed rail 12 is inserted and supported once the height of the support member 28 has been adjusted to the desired level by screwing the support member 28 into or out of the adapter 22 in conventional manner.

In order to increase the range of adjustability of the support apparatus 10, a steel tube 32 is provided for interposing between the base block 14 and the adapter 22. It will be appreciated that a range of lengths of tube 32 can be provided and more than one tube 32 can be interposed between the base block 14 and the adapter 22. Each tube 32 is shaped so that one end is a push-fit in the enlarged diameter portion 20 of the bore 18 in the base block 14 and so that the other end allows the adapter 22 or another tube 32 to be a push-fit therein thus forming a range of lengths of first members.

Referring now to FIG. 2 of the drawings, where two screed rails meet and need to be joined in overlapping relationship an alternative support member 34 is used having an end portion 36 provided with two slots in which the overlapping end portions of the two screed rails are supported.

Referring now to FIG. 3 of the drawings, an adjuster 38 is shown having a flat plate 40 at one end which is insertable into one of the slots of the support members 28, 34 and having a plane shaft at the other end which can be inserted into a chuck of a power tool (not shown).

In operation, when a concrete floor or slab is to be laid, the desired height of the surface of the concrete floor or slab is then marked using, for example, a known laser levelling system. The base blocks 14 of the required numbers of support apparatus 10 are placed in position where the screed rails 12 are to be located. Steel reinforcing rods or mesh are laid onto and are supported at a desired level by the upper faces of the base blocks 14 which form a rigid support. Each support apparatus 10 is then assembled utilising either an adapter 22 and support member 28, 34 or one or more tubes 32, adapter 22 and support member 28, 34. The adjuster 38 is then used to speedily adjust the height of the support 10 to the level indicated by, for example, a laser levelling system, a surveyors or builders levelling system by inserting the plate 40 thereof into the slot or one of the slots in the support member 28, 34 and rotating the adjuster 38 either by hand or with a power tool thus rotating the support member 28, 34 to screw it into the associated adapter 22 thereby rapidly adjusting the height of the support 10. The plate 40 of the adjuster 38 can be of the same dimensions as the screed rail 12 to be supported so that the upper end of the plate 40 can be used as an accurate indicator of the height of the upper surface of the screed rail 12 when it is brought to the level of the laser light beam of the laser levelling system or into alignment with the surveyors or builders levelling systems. Alternatively, a datum mark can be formed on the shaft 42 of the adjuster 38 which is then brought into alignment with the laser light beam of the laser levelling system or into alignment with the surveyors or builders levelling systems. The use of support apparatus 10 having a solid base block 14, steel adapter 22, support member 28, 34 which is screwed therein and where required one or more tubes 32 which are push-fits against a rigid face of the bore 18 in the base block 14 provide a heavy duty rigid support and accurate level for the screed rails 12. During pouring of the concrete to form the concrete floor or slab, a roller beam levelling device, a vibrating roller beam levelling device or the like is supported on the upper faces of the screed rails 12 and thus an accurate level of floor or slab can be achieved. After pouring and levelling of the concrete, the screed rails 12 can either be left in situ for heavy duty applications or can be immediately removed after levelling and the use of support members 28, 34 having end portions 30, 36 of relatively small cross-sectional area causes minimum disturbance to the laid concrete surface.

In a modification, the enlarged portion 20 of the bore 18 in the base block 14, both ends of the tube 32 and the end of the adapter 22 which fits into either the enlarged portion 20 of the bore 18 in the base block 14 or into the appropriate end of the tube 32 are of a non-circular shape in cross-section to prevent rotational movement of the adapter 22 and/or the tube 32 relatively to the block 14 during rotation of the support member 28, 34 to effect adjustment of the height of the support apparatus 10.

It will be appreciated that one convenient non-circular cross-section which can be used is a hexagonal cross-section which would also allow the adapter 22 to be replaced by a conventional hexagonally shaped nut (not shown) thereby simplifying the construction of the support apparatus 10.

In a further modification, referring now to FIG. 4 of the drawings, there is shown an alternative shape of base block 44 of substantially rectangular cross-section where the width and depth are different and in addition the top face 46 and one side face 48 are provided with two transversely extending slots 50 and 52 respectively, the slots 50 being of a shallower depth than the slots 52.

In the first position (a) of the block shown in FIG. 4, steel reinforcing mesh or the like (not shown) is supported in the slots 50 at a height of, for example, 40 millimetres above the ground 16 and the support apparatus 10 can be located in the bore 56.

In the second position (b) of the block shown in FIG. 4, steel reinforcing mesh or the like (not shown) is supported on the face 58 of the block at a height of, for example, 50 millimetres above the ground 16 and the support apparatus 10 can be located in the bore 60.

In the third position (c) of the block 44 shown in FIG. 4, steel reinforcing mesh or the like (not shown) is supported in the slots 52 at a height of, for example, 75 millimetres above the ground 16 and the support apparatus 10 can be located in the bore 62.

In the fourth position (d) of the block 44 shown in FIG. 4, steel reinforcing mesh or the like (not shown) is supported on the face 64 of the block at a height of, for example, 100 millimetres above the ground 16 and the support apparatus 10 can be located in the bore 66.

The provision of this substantially E-shaped block 44 having additional bores 56, 60, 62 and 66 enables the orientation of the block 44 to be varied as shown in FIG. 4 thereby giving different ranges of height of support for the steel reinforcing mesh (not shown) on the block 44 and the screed rails (not shown) on the support member 28, 34 of the apparatus 10 above the ground 16.

Although the support apparatus according to the invention is particularly suitable for use in supporting screed rails during the laying of concrete floors, roads or other surfaces in the support members 28, 34, it will be appreciated it can be used in other applications such as supporting steel reinforcing rods or mesh alone in the support members 28, 34 or said support members can be provided with different shapes of ends such as circular ends to allow the insertion of pipes (not shown) for carrying services, without departing from the scope of the invention.

The invention claimed is:

1. A support apparatus for supporting at a desired height at least one elongate member such as a rail used in laying a concrete floor, road or other surface comprising a ground engaging base block having different height to width, a first member releasably connected at its lower end to the upper face of the base block by a push fit, and a support member releasably connected to the upper end of the first member for supporting the elongate member at a desired height above the ground, wherein the first member and support member combination is of adjustable length to permit adjustment of the height of the elongate member supported thereby above the ground and thus the level of the concrete floor, road or other surface which is to be laid.

2. A support apparatus according to claim 1, wherein the releasable connection between the first member and the support member is a screw-threaded connection to enable the length of the combination to be adjusted.

3. A support apparatus according to claim 1, wherein the base block has a bore in the upper face and a bore in the side face and at least the lower end of the first member is push-fit in either one of the bores to form the releasable connection.

4. A support apparatus according to claim 3, wherein each one of the bores extend through the base block.

5. A support apparatus according to claim 3, wherein each bore has an enlarged end portion into which at least the lower end of the first member is push-fit until the end face thereof engages in contact with the end face of the enlarged end portion of the bore.

6. A support apparatus according to claim 5, wherein the first member comprises two or more components consisting of at least one hollow tubular member whose lower end is push-fit into the enlarged end portion of the associated bore in the base block and an internally screw-threaded hollow adapter which is a push-fit into an enlarged diameter end portion of the associated hollow tubular member remote from the base block.

7. A support apparatus according to claim 6, wherein the enlarged end portion of each bore in the base block, the lower end of the first member which is push fit therein, the lower end of the hollow tubular member which is one component of the first member, the enlarged end portion of the hollow tubular member remote from the base block, and the adapter which is a second component of the first member and is push-fit into either the enlarged end portion of the hollow tubular member remote from the base block or into the enlarged end portion of the associated bore in the base block are of non-circular shape in cross-section to prevent rotation of the first member, the components thereof and the adapter relative to the base block.

8. A support apparatus according to claim 7, wherein the enlarged end portion of each bore in the base block, the lower end of the first member which is push fit therein, the lower end of the hollow tubular member which is one component of the first member, the enlarged end portion of the hollow tubular member remote from the base block, and the adapter which is a second component of the first member and is push-fit into either the enlarged end portion of the hollow tubular member remote from the base block or into the enlarged end portion of the associated bore in the base block are of hexagonal shape in cross-section to prevent rotation of the first member, the components thereof and the adapter relative to the base block.

9. A support apparatus according to claim 6, wherein the support member has an externally screw-threaded portion which is screwed into the internally screw-threaded adapter to provide adjustment of the length of said combination.

10. A support apparatus according to claim 1, wherein the base block is rectangular in shape.

11. A support apparatus according to claim 1, wherein at least one face of the base block is formed with two or more transversely extending grooves or channels adapted to receive, locate and support therein one or more steel reinforcing rods or portions of steel reinforcing mesh to support said rods or mesh at a suitable height above the ground and a suitable depth below the surface of the concrete floor, road or other surface to be laid.

12. A support apparatus according to claim 1, wherein the base block is formed of concrete.

13. A support apparatus according to claim 1, wherein the base block is formed of a plastics material.

14. A support apparatus for supporting at a desired height at least one elongate member such as a rail used in laying a concrete floor, road or other surface comprising a ground engaging base block having different height to width, a first member releasably connectable at its lower end to at least two different faces of the base block and a support member releasably connected to the upper end of the first member for supporting the elongate member at a desired height above the ground, wherein the first member and support member combination is of adjustable length to permit adjustment of the height of the elongate member supported thereby above the ground and thus the level of the concrete floor, road or other surface which is to be laid, wherein the base block having different height to width provides differing ranges of height according to the face of the base block which is disposed uppermost.

* * * * *